United States Patent [19]

Billingsley et al.

[11] 4,373,479

[45] Feb. 15, 1983

[54] FUEL SYSTEM PROVIDING PRIMING AND AUTOMATIC WARM UP

[75] Inventors: Henry C. Billingsley, Waukegan; Chester G. DuBois, Zion, both of Ill.

[73] Assignee: Outboard Marine Corporation, Waukegan, Ill.

[21] Appl. No.: 176,079

[22] Filed: Aug. 7, 1980

[51] Int. Cl.[3] ..... F02M 1/16

[52] U.S. Cl. ..... 123/187.5 R; 123/179 G; 123/447

[58] Field of Search ..... 123/187.5 R, 179 G, 123/179 L, 180 E, 447

[56] References Cited

U.S. PATENT DOCUMENTS

| | | | |
|---|---|---|---|
| 2,287,900 | 6/1942 | Parker | 123/187.5 R |
| 3,371,658 | 3/1968 | Turner | 123/187.5 R |
| 3,614,945 | 10/1971 | Schlagmüller et al. | 123/179 G |
| 3,620,202 | 11/1971 | Ross | 123/179 G |
| 3,805,758 | 4/1974 | May | 123/187.5 R |
| 4,194,483 | 3/1980 | McChesney et al. | 123/187.5 R |
| 4,204,511 | 5/1980 | Morris | 123/187.5 R |
| 4,216,757 | 8/1980 | Romann | 123/179 L |

*Primary Examiner*—Charles J. Myhre
*Assistant Examiner*—Andrew M. Dolinar
*Attorney, Agent, or Firm*—Michael, Best & Friedrich

[57] ABSTRACT

Disclosed herein is a fuel supply system for an internal combustion engine including a combustion chamber and an ignition switch operable between "off" and "on" and "start" positions, which fuel supply system comprises a carburetor communicating with the combustion chamber, a primer fuel inlet communicating with the combustion chamber, a manually operable fuel pump connected in series with a power operated fuel pump and communicating with a source of fuel and with the carburetor, a housing defining a chamber, a movable wall located in and supported by the housing and dividing the chamber into a first sub-chamber communicating with the fuel pumps and a second sub-chamber, a spring biasing the movable wall to increase the volume of the second sub-chamber and to decrease the volume of the first sub-chamber, and a valve having an inlet communicating with the fuel pumps, an outlet communicating with the second sub-chamber and with the primer fuel inlet, and a valve member located between the inlet and the outlet, movable between open and closed positions, biased toward the closed position, and moveable to the open position in response to movement of the ignition switch to the "start" position.

10 Claims, 1 Drawing Figure

FUEL SYSTEM PROVIDING PRIMING AND AUTOMATIC WARM UP

BACKGROUND OF THE INVENTION

Figure 1:
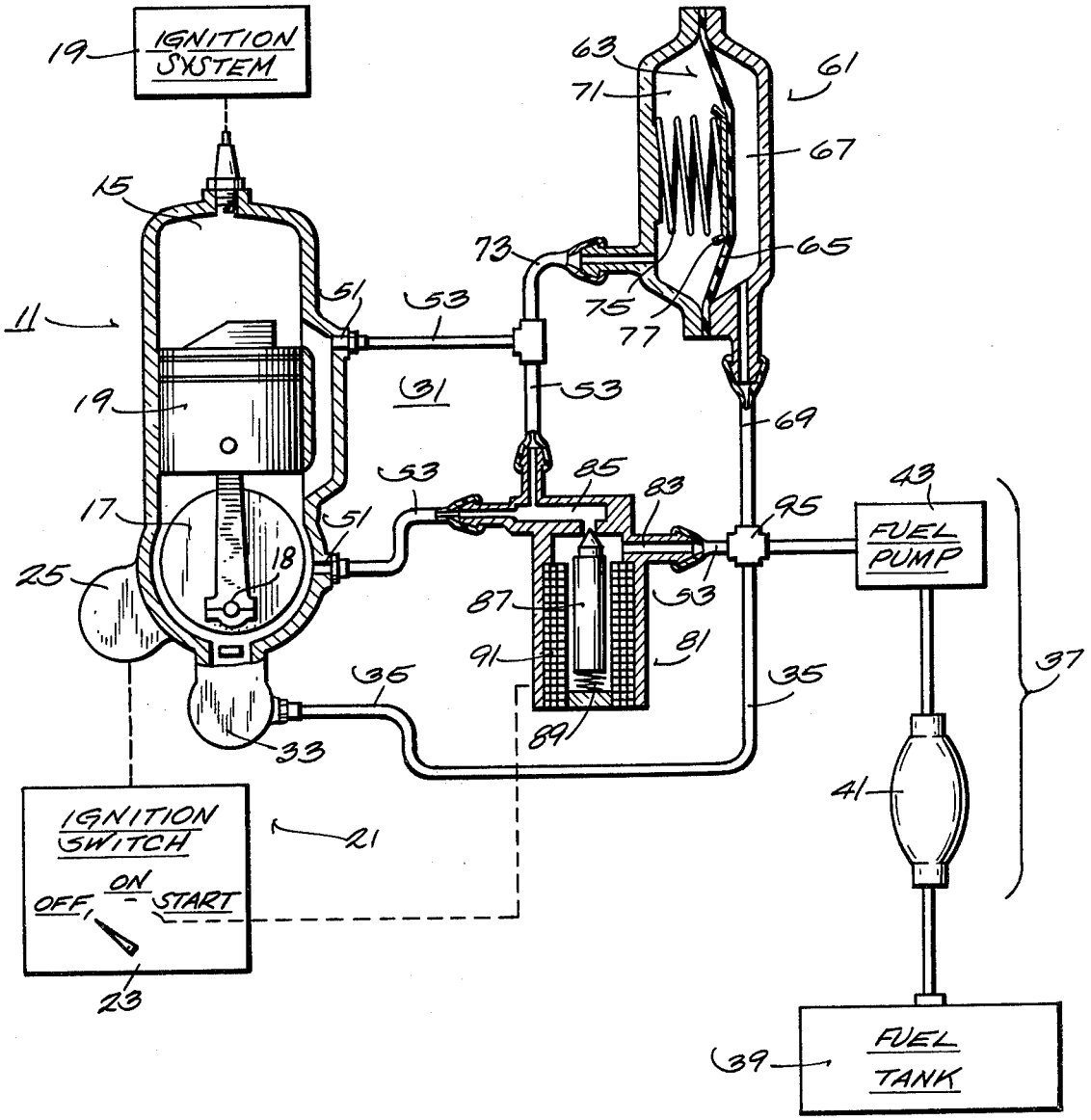

The invention relates generally to systems for supplying fuel to internal combustion engines. More particularly, the invention relates to fuel supply systems for supplying fuel for priming of the engine to facilitate starting and for sustaining normal engine operation.

The invention also relates to supplying fuel for warming up an engine.

The following U.S. patents disclose fuel supply systems:

Parker No. 2,287,900 issued June 30, 1942
Turner No. 3,371,658 issued Mar. 5, 1968
Vallin No. 3,386,423 issued June 4, 1968
Bassot No. 3,516,395 issued June 23, 1970
Ross No. 3,620,202 issued Nov. 16, 1971
Rivere No. 3,935,853 issued Feb. 3, 1976

SUMMARY OF THE INVENTION

The invention provides a fuel supply system for an internal combustion engine including a combustion chamber, which fuel system comprises means operable for supplying priming fuel to the combustion chamber and for automatically supplying additional fuel to the combustion chamber in response to supplying priming fuel to the combustion chamber and initiation of engine starting.

In one embodiment of the invention, the means for supplying priming fuel and for automatically supplying additional fuel to the combustion chamber comprises a primer fuel inlet comunicating with the combustion chamber, fuel pumping means communicating with a source of fuel, a housing incluing means defining a chamber, a movable wall located in and supported by the housing and dividing the chamber into a first sub-chamber communicating with the fuel pumping means and a second sub-chamber, means biasing the movable wall to increase the volume of the second sub-chamber and to decrease the volume of the first sub-chamber, a valve having an inlet communicating with the fuel pumping means, an outlet communicating with the second sub-chamber and with the primer fuel inlet, and a valve member located between the inlet and the outlet and movable between open and closed positions, means biasing the valve member to the closed position, and means operable in response to initiation of engine starting for moving the valve member to the open position.

In one embodiment of the invention, the fuel pumping means comprises, in series, a manually operable device for pumping fuel and a power operated device for pumping fuel.

In one embodiment of the invention, the fuel pumping means also communicates with a carburetor communicating with the combustion chamber.

In one embodiment of the invention, the engine includes an ignition switch operable between "off" and "on" and "start" positions, and the valve member is moved to the open position in response to movement of the the ignition switch to the "start" position.

Other features and advantages of the embodiments of the invention will become known by reference to the following general description, claims, and drawings.

THE DRAWINGS

FIG. 1 is a schematic view of a fuel supply system embodying various of the features of the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is an internal combustion engine 11 which is shown schematically and which includes a combustion chamber 15 and a crank case 17, which includes a rotatably mounted crankshaft 18, and which experiences alternate conditions of relatively high pressure and low pressure in response to reciprocation of a piston 19. The engine 11 also includes a suitable ignition system 21 including an ignition starter switch 23 operable between "off" and "on" and "start" positions and an electric starter motor 25 which is actuated in response to movement of the ignition switch 21 to the "start" position.

Still more particularly, the engine 11 includes a fuel supply system 31 operable to supply priming fuel to the engine combustion chamber 15 for initial starting, to automatically supply additional fuel to the engine combustion chamber 15 in response to priming and iniation of engine starting, and to thereafter continuously supply fuel to the engine combustion chamber 15. The fuel supply system 31 includes a carburetor 33, such as for instance, a float bowl carburetor which communicates in the usual fashion with the combustion chamber 15 and which supplies fuel to the combustion chamber 15 in response to the throttle setting and the rate of piston reciprocation, as is well known in the art.

In turn, the carburetor 33 communicates through a fuel supply conduit 35 with fuel supply or pumping means 37 communicating with a source of fuel, such as for instance, a fuel tank 39. The fuel supply or pumping means 37 includes, in series, a manually operable pumping or priming means which can be in the form of a primer bulb 41 and which is actuatable to prime the fuel supply system 31, to supply priming fuel to the combustion chamber 15 and, in association with other components still to be disclosed, to cause additional fuel to be supplied to the combustion chamber 15 upon iniation of engine starting.

In addition, the fuel supply or pumping means 37 includes a power operated fuel pump 43 which is operable to supply fuel to the carburetor 33 to sustain normal engine operation and which is operated simultaneously with engine operation. While various power operated fuel pumps can be employed, in the disclosed construction, the fuel pump is conventional in construction and is subject to and is operated in response to reciprocial pressure variation in the engine crankcase 17. It is noted that the primer bulb 41 is operable to pump fuel through the power operated fuel pump 43 when the pump 43 is not operating. Such primer bulbs 41 and power operated fuel pumps 43 are well known in the art and need not be further described. If desired, an electrically powered fuel pump, operable in response to operation of the ignition switch 23, could also be employed.

The fuel supply system 31 also includes one or more primer fuel inlets 51 which can be suitably constructed and located on the engine 11 so as to supply primer fuel directly to the combustion chamber 15 or through the crankcase 17 to the combustion chamber 15, and which communicate with the fuel supply or pumping means 37 through a conduit 53. The primer bulb 41, the primer fuel inlet or inlets 51, and the conduit 53 provide means for supplying priming fuel to the combustion chamber 15.

Means are also provided for automatically supplying additional fuel to the combustion chamber 15 in response to priming of the engine and initiation of engine starting. While various arrangements can be employed, in the illustrated construction, such means comprises a housing 61 including means defining an interior chamber, together with a movable wall 65 supported by the housing 61 and located in the chamber 63 so as to divide the chamber 63 into a first sub-chamber 67 which communicates through a conduit 69 with the fuel supply or pumping means 37 and a second sub-chamber 71 which communicates through a conduit 73 with the conduit 53 leading to the primer fuel inlet or inlets 51. While various arrangements can be employed, in the illustrated construction, the movable wall 65 is provided by a flexible diaphragm.

The means for automatically supplying additional fuel to the combustion chamber 15 in response to priming and initiation of engine starting also includes means for biasing the movable wall 65 so as to decrease the volume of the first sub-chamber 67 and so as also to increase the volume of the second sub-chamber 71. While various arrangements can be employed, in the illustrated construction, there is provided a helical spring 75 which has a first end bearing against the housing 61 and a second end bearing against a cup 77 secured to the diaphragm 65.

The means for automatically supplying additional fuel to the combustion chamber in response to priming and initiation of engine starting further includes a valve 81 which is located in the conduit 53 between the fuel supply or pumping means 37 and the connection with the conduit 73 leading from the second sub-chamber 71, and which is operable between open and closed positions.

While various arrangements can be employed, in the illustrated construction, the valve 81 includes an inlet 83 communicating through the conduit 53 with the fuel supply or pumping means 37, and an outlet 85 communicating through the conduit 53 with the primer fuel inlet or inlets 51 and through the conduit 73 with the second sub-chamber 71.

The valve 81 also includes a suitable valve member 87 located between the inlet 83 and outlet 85 and movable between an open position affording fuel flow through the conduit 53 and a closed position preventing fuel flow through the conduit 53.

Means are provided for biasing the valve 81 to the closed position. While various arrangements can be employed, in the illustrated construction, such means comprises a helical spring 89 engaged with the valve member 87.

Means are also employed for opening the valve 81 in opposition to the spring 87 and in response to operation of the ignition switch 23 beyond the "on" position to the "start" position. While various arrangements can be employed, in the illustrated construction, the valve 81 is solenoid operated and includes a solenoid coil 91 in surrounding relation to the valve member 87, which coil 91 is energized by suitable connections (not shown) to a source of electricity, as for instance, a battery (not shown) incident to operation of the ignition switch 23 to the "start" position.

It is noted that the conduits 35, 53, and 69 communicate with a common fitting 95 which, in turn, communicates with the fuel supply or pumping means 37. Accordingly the conduits 35, 53 and 69 experience a common pressure at all times.

In operation, the primer bulb 41 is first manually actuated to pump fuel through the system 31 to the carburetor float bowl (not shown), to fill the conduit 53, at least as far as the valve 81, and to fill the first sub-chamber 67 so as to increase the volume thereof and consequently to decrease the volume of the second sub-chamber 71 against the action of the spring 75. Such diminishment in the volume of the second sub-chamber 71 serves to expel fuel previously supplied thereto from the second sub-chamber 71 and to cause flow of such fuel through the conduits 73 and 53 to the primer fuel inlet or inlets 51. Accordingly, the fuel system 31 is primed and, in addition, priming fuel is supplied for the combustion chamber 15.

Thereafter, when the fuel supply system 31 is conditioned as just explained, the ignition key (not shown) is operated from the "off" position, through the "on" position and to the "start" position to effect cranking of the engine 11 by the starter motor 25 so as to initiate starting. Such action also energizes the solenoid coil 91 to open the valve 81. Upon opening of the valve 81, the spring 75 serves to decrease the volume of the first sub-chamber 67, forcing the fuel therefrom and through the conduits 69, 53 and 73 to re-supply the second sub-chamber 71 with fuel for the next priming operation and, in conjunction with the pressure in the conduits 69 and 53, to additionally and automatically supply a part of the fuel from the first sub-chamber 67 through the primer fuel inlet or inlets 51 to the combustion chamber 15 to provide fuel for initial priming or engine warm-up. Upon engine rotation, the power operated fuel pump 43 will fully re-supply the second sub-chamber 71 with fuel and upon movement of the ignition key to the "on" position from the "start" position, the solenoid coil 91 is denergized and the valve 81 is closed under the action of the spring 89. With the valve 81 closed, fuel pump operation then serves to again supply fuel to the first sub-chamber 67, thereby also forcing fuel from the second sub-chamber 71 for engine warm-up. Thereafter, the system 31 is in normal running condition and in readiness for the next starting operation.

The valve solenoid coil 91 can also be energized in response to insertion of a choke button (not shown) to close a choke (not shown) or in response to depression of a primer button (not shown).

Various of the features of the invention are set forth in the following claims.

We claim:

1. A fuel supply system for an internal combustion engine including a combustion chamber and a rotatably mounted crankshaft, said fuel system comprising means operable for supplying priming fuel to said combustion chamber and for automatically supplying additional fuel to said combustion chamber independently of crankshaft rotation and in response to supplying priming fuel to said combustion chamber and initiation of engine starting.

2. A fuel supply system for an internal combustion engine including a combustion chamber, said fuel system comprising a primer fuel inlet communicating with said combustion chamber, fuel pumping means communicating with a source of fuel, a housing including means defining a chamber, a movable wall located in and supported by said housing and dividing said chamber into a first sub-chamber communicating with said fuel pumping means and a second sub-chamber, means biasing said movable wall to increase the volume of said second sub-chamber and to decrease the volume of said first sub-chamber, a valve having an inlet communicating upstream thereof with said fuel pumping means, an outlet communicating downstream thereof with said second sub-chamber and with said primer fuel inlet, and a valve member located between said inlet and said outlet and movable between open and closed positions, means biasing said valve member to the closed position, and means operable in response to initiation of engine starting for moving said valve member to the open position.

3. A fuel supply system in accordance with claim 2 wherein said fuel pumping means comprises, in series, a manually operable device for pumping fuel and a power operated device for pumping fuel.

4. A fuel supply system in accordance with claim 3 wherein said fuel pumping means also communicates with a carburetor communicating with said combustion chamber.

5. A fuel supply system for an internal combustion enginer including a combustion chamber and an ignition switch operable between "off" and "on" and "start" positions, said fuel supply system comprising, a carburetor communicating with said combustion chamber, a primer fuel inlet communicating with said combustion chamber, fuel pumping means communicating with a source of fuel and with said carburetor and including, in series, a manually operable device for pumping fuel and a power operated device for pumping fuel, a housing including means defining a chamber, a movable wall located in and supported by said housing and dividing said chamber into a first sub-chamber communicating with said fuel pumping means and a second sub-chamber, means biasing said movable wall to increase the volume of said second sub-chamber and to decrease the volume of said first sub-chamber, a valve having an inlet communicating with said fuel pumping means, an outlet communicating with said second sub-chamber and with said primer fuel inlet, and a valve member located between said inlet and said outlet and movable between open and closed positions, means biasing said valve member to the closed position, and means operable in response to movement of said ignition switch to said "start" position for moving said valve member to the open position.

6. A fuel supply system for an internal combustion engine including a combustion chamber, and a rotatably mounted crankshaft, said fuel system comprising means operable for supplying priming fuel to said combustion chamber and for automatically supplying additional fuel to said combustion chamber independently of crankshaft rotation and in response to supplying priming fuel to said combustion chamber and initiation of engine starting, said means including fuel pumping means communicating between a source of fuel and said combustion chamber for supplying fuel to said combustion chamber, and variable volume additional means communicating with said combustion chamber and said pumping means for additionally supplying fuel to said combustion chamber.

7. A fuel supply system for an internal combustion engine including a combustion chamber, said fuel system comprising means operable for supplying priming fuel to said combustion chamber and for automatically supplying additional fuel to said combustion chamber in response to supplying priming fuel to said combustion chamber and initiation of engine starting, said means including fuel pumping means communicating between a source of fuel and said combustion chamber for supplying fuel to said combustion chamber and a chamber having therein a movable wall which divides said chamber into first and second sub-chambers and which is biased to increase the volume of said second sub-chamber and to decrease the volume of said first sub-chamber, said first sub-chamber communicating with said pumping means and said second sub-chamber communicating with said combustion chamber and selectively with said pumping means.

8. A fuel supply system for an internal combustion engine including a combustion chamber, said fuel system comprising means operable for supplying priming fuel to said combustion chamber and for automatically supplying additional fuel to said combustion chamber in response to supplying priming fuel to said combustion chamber and initiation of engine starting, said means including a chamber including therein a movable wall dividing said chamber into first and second sub-chambers, said second sub-chamber communicating with said combustion chamber, means biasing said movable wall to increase the volume of said second sub-chamber and to decrease the volume of said first sub-chamber, and fuel pumping means communicating with said first and second sub-chambers and with said combustion chamber.

9. A priming fuel supply system for an internal combustion engine including a combustion chamber, said fuel system comprising fuel pumping means communicating with a source of fuel, a chamber including therein a movable wall dividing said chamber into a first sub-chamber communicating with said fuel pumping means and a second sub-chamber, means biasing said movable wall to increase the volume of said second sub-chamber and to decrease the volume of said first sub-chamber, and a valve operable between open and closed positions and having an inlet communicating upstream thereof with said fuel pumping means, and an outlet communicating downstream thereof with said second sub-chamber and with said combustion chamber.

10. A priming fuel supply system for an internal combustion engine including a combustion chamber, said fuel system comprising fuel pumping means communicating with a source of fuel, a chamber including therein a movable wall dividing said chamber into a first sub-chamber communicating with said fuel pumping means and a second sub-chamber, means biasing said movable wall to increase the volume of said second sub-chamber and to decrease the volume of said first sub-chamber, a valve operable between open and closed positions and having an inlet communicating upstream thereof with said fuel pumping means, and an outlet communicating downstream thereof with said second sub-chamber and with said combustion chamber, said valve being biased to the closed position and being operable in response to initiation of engine starting to move to the open position.

* * * * *